US006663759B1

(12) United States Patent
Copping et al.

(10) Patent No.: US 6,663,759 B1
(45) Date of Patent: Dec. 16, 2003

(54) METHOD FOR CONTINUOUSLY MASKING A WEB

(75) Inventors: William J. Copping, Youngstown; Paul M. Bronschidle, Sanborn; Richard J. Zimmermann, Tonawanda, all of NY (US)

(73) Assignee: Precious Plate, Inc., Niagara Falls, NY (US)

( * ) Notice: Subject to any disclaimer, the term of this patent is extended or adjusted under 35 U.S.C. 154(b) by 207 days.

(21) Appl. No.: 09/616,192

(22) Filed: Jul. 14, 2000

Related U.S. Application Data

(62) Division of application No. 09/165,217, filed on Oct. 1, 1998, now Pat. No. 6,143,145.
(60) Provisional application No. 60/060,737, filed on Oct. 2, 1997.

(51) Int. Cl.[7] ..... C25D 5/02; C25D 5/08
(52) U.S. Cl. ..... 205/118; 205/129; 205/133
(58) Field of Search ..... 205/93, 118, 129, 205/133, 137, 138

(56) References Cited

U.S. PATENT DOCUMENTS

| | | | | |
|---|---|---|---|---|
| 3,974,056 A | 8/1976 | Jogwick | ..... | 204/207 |
| 4,082,632 A | 4/1978 | Whittle | ..... | 204/129.65 |
| 4,132,617 A | 1/1979 | Noz | ..... | 204/206 |
| 4,431,500 A | 2/1984 | Messing et al. | ..... | 204/206 |
| 4,560,445 A | 12/1985 | Hoover et al. | ..... | 204/15 |
| 4,582,583 A | 4/1986 | Laverty et al. | ..... | 204/206 |
| 4,895,632 A | 1/1990 | Hoyer | ..... | 204/206 |
| 5,242,562 A | 9/1993 | Beyerle et al. | ..... | 204/206 |
| 5,372,699 A | 12/1994 | Rischke et al. | ..... | 205/129 |
| 5,429,738 A | 7/1995 | Beyerle et al. | ..... | 205/125 |

*Primary Examiner*—Donald R. Valentine
*Assistant Examiner*—Erica Smith-Hicks
(74) *Attorney, Agent, or Firm*—Hodgson Russ LLP

(57) ABSTRACT

A method for continuously electroplating metal webs by coating a masking ink thereto in a fashion resembling flexographic printing, then electroplating the uncoated areas of the web and finally removing the ink, is described. The masking ink is applied continuously from a reservoir to an "anilox" roller which synchronously and rotatingly contacts either a plate roller or an intermediate roller. Contact between the rollers transfers the masking ink from one roller to the other. The plate roller has "proud" or raised areas in which the ink is drawn and contacts a guided metal web that is coated with the ink in a pattern matching that of the plate roller. Electroplating is effected after cleaning the inked web in an aqueous acid media. Finally, the masking ink is removed in an alkali medium.

13 Claims, 4 Drawing Sheets

METHOD FOR CONTINUOUSLY MASKING A WEB

CROSS-REFERENCE TO RELATED APPLICATION

This application claims priority based on provisional application Serial No. 60/060,737 filed Oct. 2, 1997 and is a divisional of application Ser. No. 09/165,217, filed Oct. 1, 1998 now U.S. Pat. No. 6,143,145 issued Nov. 7, 2000.

BACKGROUND OF THE INVENTION

1. Field of the Invention

The present invention generally relates to a selectively plated substrate and, more particularly, to an apparatus for continuously masking selected areas of a metal web with a non-conductive coating. The masked web is then processible in an electroplating apparatus followed by stripping the maskant to produce a web having selectively plated and unplated areas. The present invention is particularly advantageous for plating narrow, well defined metal stripes on a metal web.

2. Prior Art

It is known to selectively electroplate a metal web with plated stripes by first applying a resist to the metal surface, plating the areas devoid of resist material and then removing the resist after the plating step. Several techniques are known for accomplishing this including applying a liquid resist by silk screening, applying a dry resist by laminating the resist material to the metal web, and applying a resist by electrophoretic deposition. These techniques do not necessarily provide a plated pattern having sharp definition and close location tolerances. Further, dry photo resists are much more costly than the non-conductive ink maskant of the present invention. Electrophoretic resists, while less costly than dry resists are still more costly than the present ink maskant. Also, electrophoretic resists can not be applied at speeds comparable with the present invention.

Another technique that provides improved plating definition uses a photo resist applied over the entire workpiece by one of the liquid resist, dry resist or electrophoretic deposition techniques. The photo resist is then selectively exposed by interposing a mask between a source of actinic radiation and the resist coated workpiece. This causes the exposed area to be more soluble in the case of a positive photo resist, or less soluble in the case of a negative photo resist when the workpiece is subsequently immersed in a developing solution. Such an electrophoretically applied photo resist technique is described in European Patent Application 0 507 043 A2. Again, electrophoretically deposited resists are more costly than the present ink maskants, and their process speeds are slower than the present invention.

Still another prior art process uses mechanical masks such as moving belts to produce stripes of electrodeposited material while the belt contacted portions of the substrate are left unplated. However, this technique is inadequate for producing thin, well defined stripes because fabricating very narrow belts and locating them accurately against the web to be masked presents many difficulties.

SUMMARY OF THE INVENTION

Accordingly, there is a need for metal web substrates that are electroplated in well defined, sharp and, if required, narrow stripes. In that respect, it is important that the unplated portions of the web are free of electro deposited metal, and the plated area transitions into the unplated area at a substantially perpendicular slope to the plane of the web. The masking apparatus and method of the present invention provide such a web substrate having well defined ink stripes applied thereto with precise boundaries and very little wander. Accordingly, important aspects of the present invention are that the applied ink maskant has extremely close width tolerances, very little wander along the length of the web and is laid down free of pinholes and like defects.

These and other aspects of the present invention will become more apparent to those skilled in the art by reference to the following description and to the appended drawings.

DESCRIPTION OF THE PREFERRED EMBODIMENTS

As defined in this application, the terms "forward", "rearward", "upper", "upwardly", and "downwardly" refer to the orientation of FIGS. 1 to 8, and are not intended to be limiting.

Figure 1:
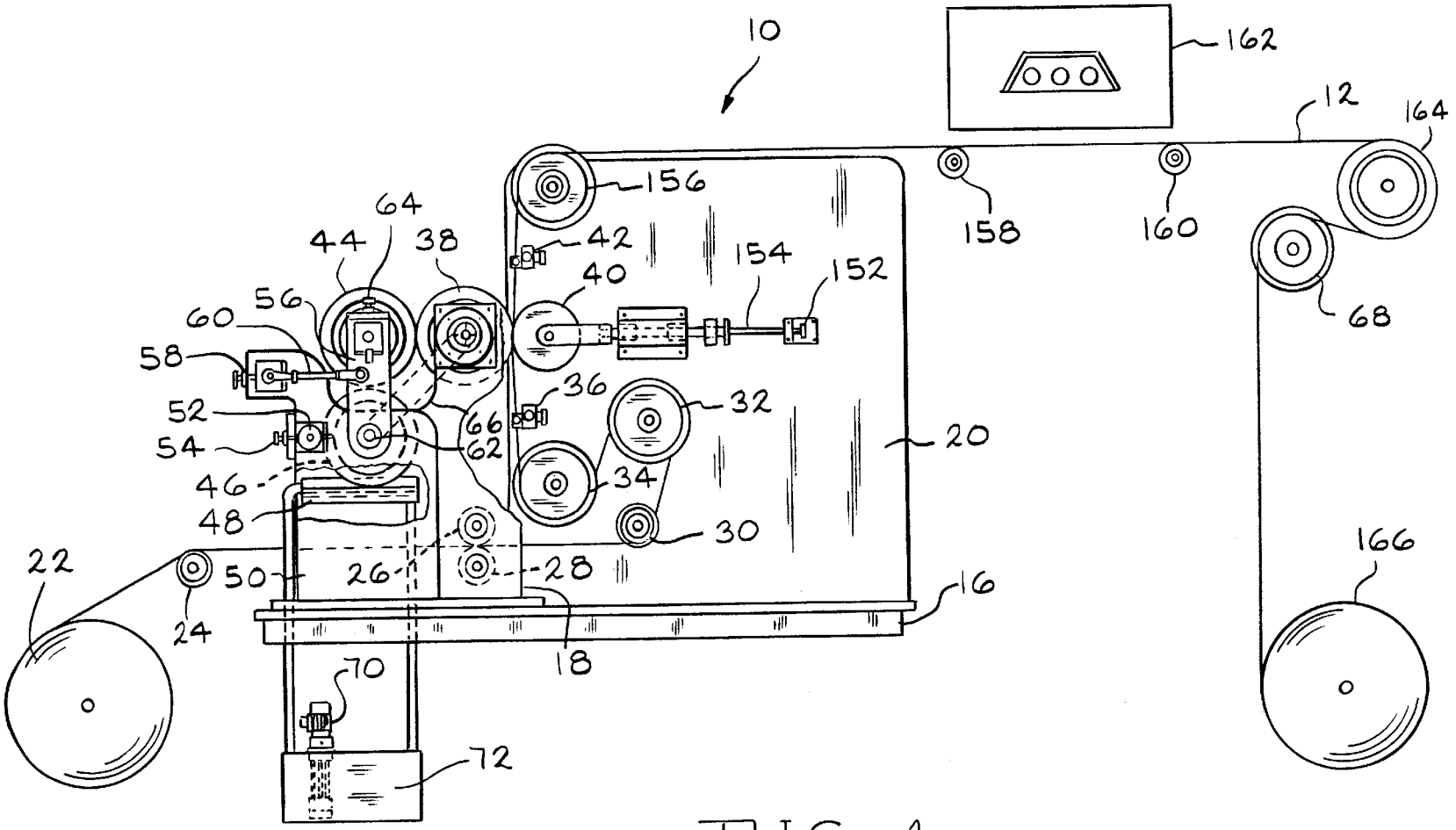
FIG. 1 is a schematic representation of an apparatus 10 for continuously applying a non-conductive ink maskant to selected areas of a web according to the present invention.
Figure 2:
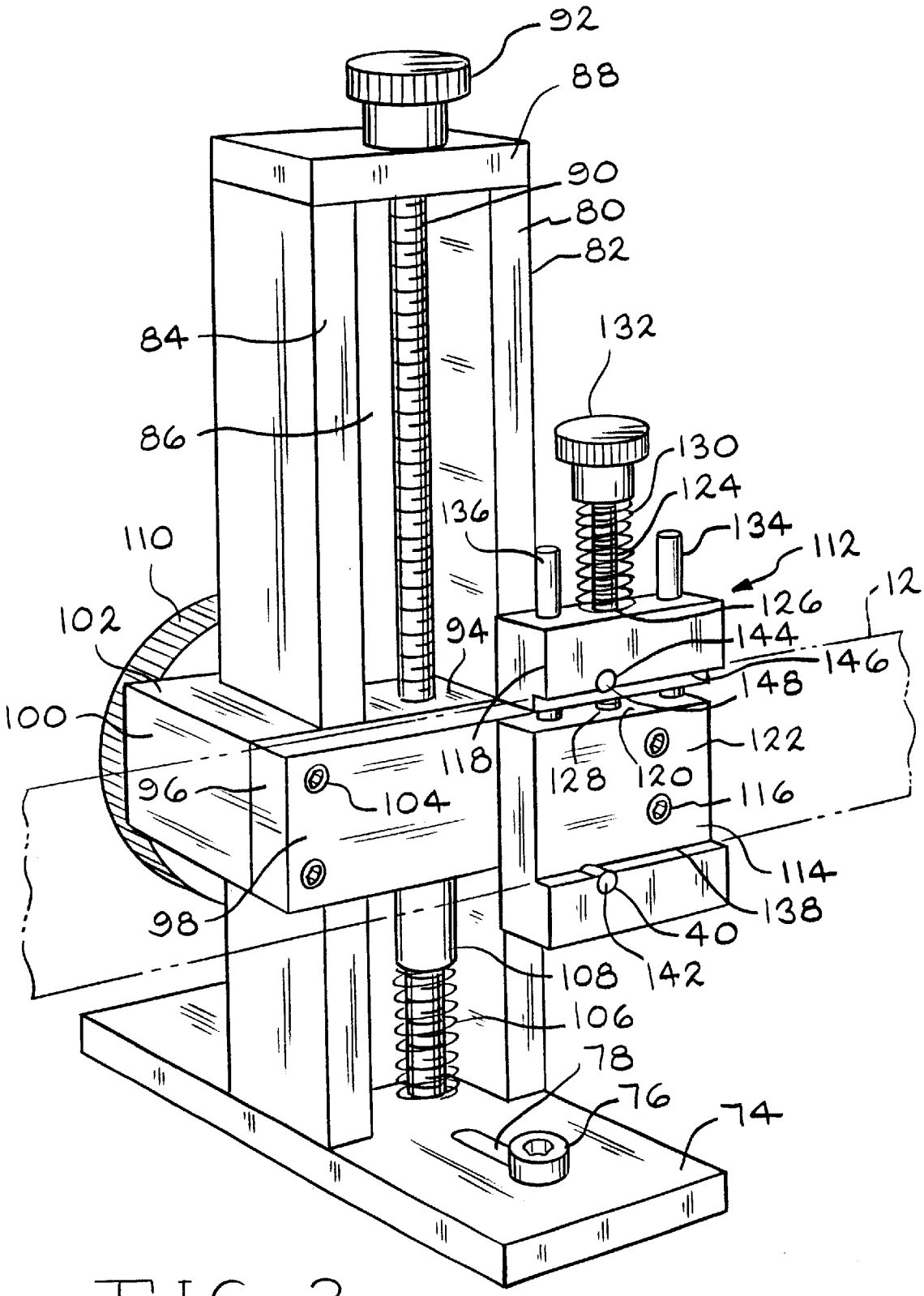
FIG. 2 is a perspective view of an adjustable guide for accurately aligning the web 12 as ink is being applied thereof.

Turning now to the drawings, FIGS. 1 and 2 schematically illustrate an apparatus 10 for continuously masking selected area of a web 12 (FIGS. 3 and 5) with stripes 14 of a masking ink according to the present invention. The continuous masking apparatus 10 includes a platform 16 having a pair of spaced apart side walls 18 (only one side wall is shown) extending upwardly therefrom at a forward end of the platform. A larger, main wall 20 extends upwardly from the platform 16 at a rearward end thereof. The spaced apart side walls 18 and the main wall 20 support various rotating rollers and guide structures for providing selected areas of the web with a non-conductive ink maskant according to the present invention, as will be described in detail presently.

The continuous masking process of the present invention begins with the web 12 initially rolled up on a spool 22 that serves as a pay-off uncoiler. The web typically has a thickness of about 0.0005 inches to about 0.040 inches. After the web 12 moves off the spool 22, the web passes over a first alignment roller 24, between a pair of second and third alignment rollers 26 and 28 rotating about shafts supported by the forward side walls 18 and under a fourth alignment roller 30 rotating about a shaft supported on the rearward, main wall 20. The web 12 leaves the fourth alignment roller 30 and travels upwardly to a first guide roller 32 and then downwardly to a second guide roller 34. The guide rollers 32 and 34 are supported by the main wall 20 and provide for coarse adjustment and tensioning of the web 12 prior to entry into a first adjustable guide 36. The web 12 now moves through the first adjustable guide 36 aligned with a cooperating plate roller 38 and an impression roller 40 and on to a second adjustable guide 42.

The plate roller 38 is provided with one or more proud areas disposed angularly about its circumference and preferably provided by a fine grinding manufacturing process and the like. The width of the proud areas and their relative location define the boundaries and the location of the masking that will occur on the web, and ultimately, the areas on the web devoid of plated material.

The plate roller 38 contacts an intermediate transfer roller 44 which, in turn, contacts an aluminum "anilox" or ink roller 46 that picks up ink 48 from a well 50. The ink roller 46 has a pattern of high and low areas etched or laser engraved on its surface. A doctor roller 52 is located immediately after the ink pick-up point to remove excess ink from the high areas of the ink roller 46. A threaded jack screw 54 provides for adjusting the pressure of the doctor roller 52 to regulate the wiping action of the doctor roller 52 against the ink roller 46. The design of the raised pattern and the depth of the recessed areas on the ink roller 46 regulate the amount of ink that is retained on the roller 46 after contact with the doctor roller 52.

The contact pressure and the angle of contact between the ink roller 46, the intermediate roller 44 and the plate roller 38 are adjustable to ensure that the rollers are square to one another and provide an even dispersion of ink on the plate roller. In particular, a pair of plates 56 (only one shown) connect the transfer roller 44 to the ink roller 46. Jack screws 58 connected to link arms 60 provide for independent adjustment of the intermediate roller 44 towards and away from the plate roller 38 as the plates 56 pivot on the shaft 62 supporting the ink roller 46. A pair of jack screws 64 (only one shown) provide for adjustment of the transfer roller 44 with respect to the ink roller 46.

The plate roller 38 and the ink roller 46 are synchronously driven from a common drive (not shown) having a chain 66 and the like connected between them. The intermediate transfer roller 44 is mounted on an idler shaft and rotates by being in light contact with the ink roller 46 and the plate roller 38. The web 12 is moved through the present masking apparatus 10 by a separate drive roller 68.

The ink 48 picked up from well 50 by the rotating ink roller 46 can be a solvent based, water soluble ink, or a UV curable formulation which is soluble in an aqueous alkaline media but insoluble in an aqueous acid media. In the alternative, the ink 48 is soluble in an aqueous acid media and insoluble in an aqueous alkaline media. The well 50 is maintained at a constant height by continuously operable pump 70 in communication with a supply container 72. The well 50 is fitted with an overflow weir (not shown) adjusted to maintain the desired ink level. The overflow ink returns by gravity to the supply container 72.

The structure of the first and second adjustable guides 36 and 42 is shown in FIG. 2. The adjustable guides each include a base 74 secured to the main wall 20 by a screw 76 disposed through a slot 78 in the base. The slot 78 provides for coarse position adjustment of the guide with respect to the travel path of the web. The base 74 supports a tower 80 having a channel shape provided by spaced apart side walls 82 and 84 extending to and meeting with a back wall 86. The back wall 86 is provided with an elongated aperture (not shown) running longitudinally along the length thereof. The tower 80 is closed by an end wall 88 having a circular aperture (not shown) through which a threaded shaft 90 extends to a blind bore (not shown) in the base 74. A hand knob 92 is provided on the shaft 90 proximate the end wall 88. The shaft 90 threadingly mates with the block portion 94 of a T-shaped slide 96. The block portion 94 is captured between the side walls 82, 84 and supports a bar portion 98 of the T-slide 96 so that rotational movement of the knob 92 and associated threaded shaft 90 raises and lowers the T-slide 96 along the length of the tower 80. The spaced apart legs 100 (only one shown) of a generally U-shaped member 102 are connected to the opposed ends of the bar portion 98 of the T-slide 96 by threaded members 104. A coil spring 106 surrounds the threaded shaft 90 and biases between the base 74 and a bushing 108 mounted on the shaft. The bushing 108 contacts the block portion 94 of the T-slide 96 under the force of the spring 106. Course positioning of the T-slide 96 is provided by rotating the shaft 90 to move the T-slide 96 along the tower 80. Once the T-slide 96 is so positioned, it is locked by threading a screw 110 into a tightened position.

The bar 98 of the T-slide 96 supports an adjustable guide 112 comprising an L-shaped bar 114 secured to the T-slide by threaded members 116. A stepped bar 118 is adjustably supported on an upper end 120 of the leg 122 of the L-bar 114 by a threaded member 124 extending through a threaded bore 126 in the stepped bar 118 and received in a threaded blind bore 128 in the L-bar 114. A spring 130 surrounds the threaded member 124 and biases between a hand knob 132 and the stepped bar 118. A pair of spaced apart guide pins 134 and 136 mounted in the upper end 120 of the L-bar 114 extend through bores in the stepped bar 118 and are disposed on opposite sides of the adjustment screw 124 to guide movement of the stepped bar 118 towards and away from the L-bar 114. The step 138 of the L-bar 114 has a cylindrical recess 140 that supports a ceramic roll pin 142. Similarly, a cylindrical recess 144 in the step 146 of bar 118 supports a ceramic roll pin 148 directly opposite the roll pin 142. The ceramic pins prevent the web, which may be as thin as 0.001 inches, from cutting into the guides. The adjustable guide side locates the reference edge of the web firmly against the fixed guide, and opens slightly when necessary to accommodate minor variances in web width. That way, the adjustable guides 36 and 42 precisely locate the web 12 with respect to the plate roller 38. A guide system with a constant, fixed width could cause edge damage to the web when the web width is wider than the fixed distance between the guides.

Figure 3:
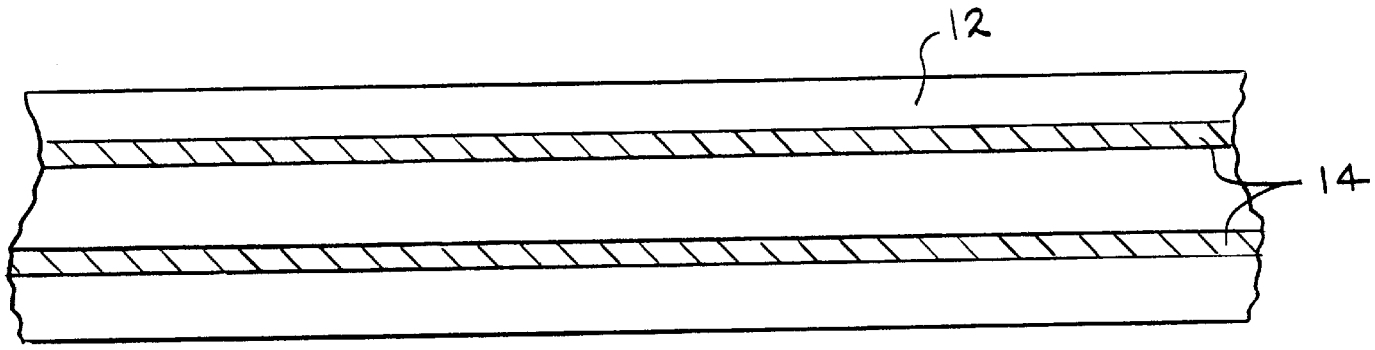
FIG. 3 is a partial plan view of a web 12 having a pair of spaced apart ink stripes 14 contacted thereto according to the present invention.
Figure 5:
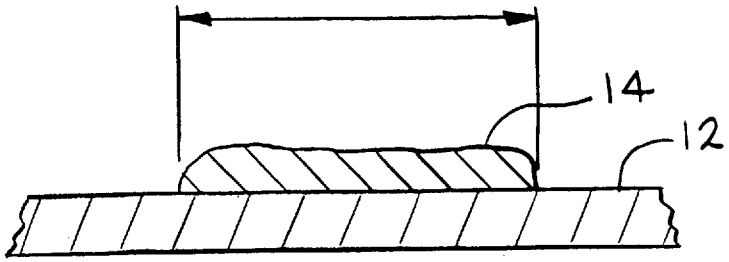
FIG. 5 is a partial cross-sectional view of FIG. 3.

The impression roller 40 is located tangential to the plate roller 38. The impression roller 40 contacts the back side of the web 12 to cause ink to transfer from the plate roller 38 to the web 12. FIG. 3 shows the web 12 having spaced part stripes 14 of ink laid thereon by the present apparatus 10. FIG. 5 is a partial cross-sectional view of FIG. 3 showing the precise boundaries of one of the ink stripes 14. The contact pressure exerted by the impression roller 40 against the web moving past the plate roller 38 is manually adjustable by turning a fine threaded screw 152 connected to a link assembly 154 to move the impression roller 40 towards the plate roller 38.

Web speed can vary from about 30 feet per minute to about 1,000 feet per minute, and preferably about 300 to about 500 feet per minute. An important aspect of the present invention is that the surface speed of the plate roller 38 can be the same as, faster, or slower than the web speed, and the direction of rotation of the plate roller can be the same as the pull direction of the web, or opposed to it. By varying the relative speed of the web and the plate roller, and/or the direction of rotation of the plate roller, a wiping action is created which causes the ink to be laid down without pinholes that are common in flexographic printing. Pinholes are undesirable since they allow plating in the region where no plating is desired.

The thickness of the deposited ink is varied by the speed and direction of rotation of the plate roller, the contact pressure between the plate and impression rollers, the design of the anilox roller and doctoring system, and the viscosity of the ink. Obviously, the thinner the ink the lower the cost. However, it is necessary to optimize the ink thickness so the coating is continuous and free of pinholes, and so the ink has sufficient ohmic resistance to withstand the electroplating voltage that will subsequently be applied to the web.

The web 12 leaves the second adjustable guide 42, moves over a third guide roller 156 and into a generally horizontal orientation. The web 12 then moves over a pair of spaced apart support rollers 158 and 160 which help to maintain the distance of the travelling web 12 past an ultraviolet light source and reflector assembly 162. The actinic radiation is preferably provided by a halide lamp which emits ultraviolet energy of about 350 nanometers to about 450 nanometers. The power of the lamp can vary depending on the web speed and the proximity of the web to the lamp.

The web 12 leaves there and loops about 270° around a fourth guide roller 164 and then over the drive roller 68 powered by a motive means for moving the web 12 through the present apparatus. The masked web 12 is then taken up on a take-up recoiler 166 for storage or further immediate processing. It can optionally be run through the masking apparatus of the present invention a second time to place stripes on its opposite side. The present apparatus can also be configured to simultaneously ink both sides of the web in a single pass. This is done by substituting a second plate roller for the impression roller. The second plate roller can be directly in contact with an ink or anilox roller, or there can be an intermediate transfer roller transferring ink from the ink roller to the second plate roller, as previously described in detail.

The coiled, masked web is then transferred to a continuous reel-to-reel plating machine. There, the web is cleaned in an acid media and then electroplated to the desired thickness with one or more metals. After electroplating, the web passes through a stripping station containing a solution to dissolve the ink. The stripping solution may be agitated by pumping action, or sprayed onto the web to increase the removal rate of the ink mask. After stripping, the web is rinsed, residual alkali is neutralized in a mild acid bath, the web is rinsed again, dried and recoiled.

Figure 4:
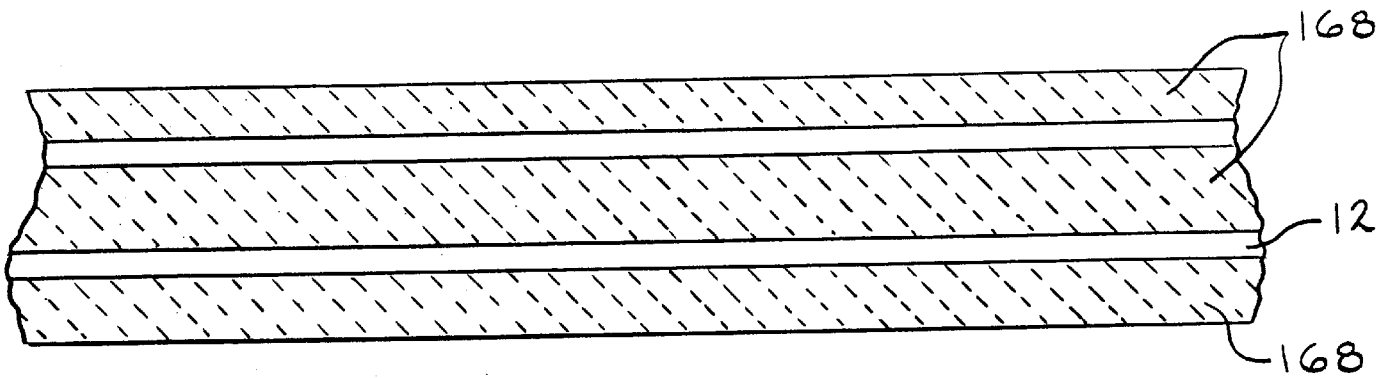
FIG. 4 is a partial plan view of the web 12 of FIG. 3 after plating and removal of the masking ink.
Figure 6:
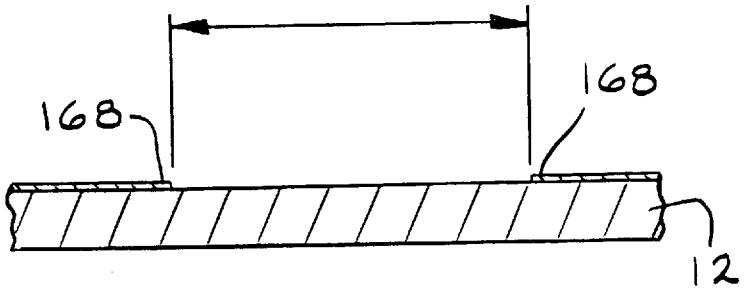
FIG. 6 is a partial cross-sectional view of FIG. 4.
Figure 8:
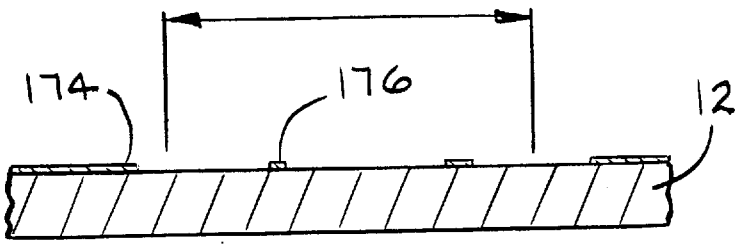
FIG. 8 PRIOR ART
FIG. 8 is a partial cross-sectional view of the web in FIG. 7 after plating and removal of the masking ink.
Figure 7:
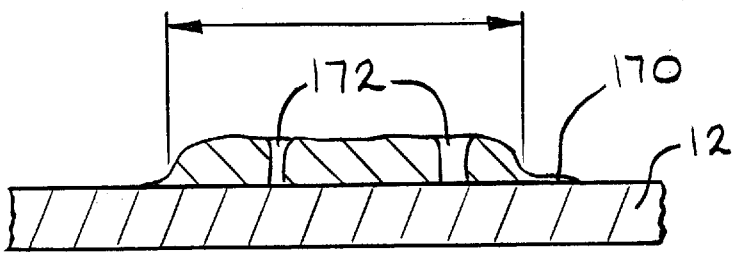
FIG. 7 PRIOR ART
FIG. 7 is a partial cross-sectional view of a web having a masking ink contacted thereto according to the prior art.

FIG. 4 shows the web of FIG. 3 after plating and removal of the masking ink. FIG. 6 is a partial cross-sectional view of FIG. 4 illustrating the precise boundaries of the plated material 168. In contrast, FIG. 7 illustrates an inked web according to the prior art having poorly defined boundaries 170 and pin holes 172. FIG. 8 illustrates the web 12 of FIG. 7 after plating and removal of the masking ink. The imprecise deposition of the plate material 174 caused by the poorly defined boundaries and pinhole plate 176 is evident.

The following example describes the manner and process of continuously masking a web substrate according to the present invention, and it sets forth the best mode contemplated by the inventors of carrying out the invention, but it is not to be construed as limiting.

EXAMPLE

A web of copper alloy having a thickness of 0.003±0.005 inches, and a width of 1.300±0.002 inches was continuously moved through an ink masking apparatus according to the present invention at a speed of about 300 feet per minute. Two stripes of ink with a targeted width of 0.125 inches were laid down using a plate roller with a polymeric surface of 55 durometer EPDM, contoured to deposit the ink in the desired area. The ratio of the surface speed of the plate roller to the speed of the web was 1.3:1. The inked web was exposed to radiation with ultraviolet light having a wavelength of 360 to 400 nanometers. The length of the exposure window in the direction of web travel was 12 inches resulting in an exposure time of 0.2 seconds. The web was then passed through the present inking apparatus a second time using the same conditions, except that the plate roller was contoured to produce two stripes with a targeted width of 0.040 inches. The thickness of the ink maskant in both cases was approximately 0.0002 inches.

The stripes were well defined, having a width variation of about ±0.010 inches, with sharp edges and no apparent pinholes. It was also determined that the boundry between the ink stripe and the unmasked web wandered ±0.0005 inches along the length of the web. The coating was hard and dry and resisted abrasion by coarse paper.

The ink used was a blend of multifunctional acrylate monomers and oligomers, photoinitiators such as benzophenone, and surfactants.

After the second pair of stripes was printed, the web was coiled up and transferred to a reel-to-reel selective plating machine. The web was passed through the various cells of the machine at 35 feet per minute. The following processes were performed continuously on the plating machine:

(1) Clean the web in an aqueous acid media containing surfactants to remove finger prints and soils.

(2) Electroplate with 0.0001 to 0.00012 inches of copper from an acid bath at a cathode current density of 200 amps per square foot.

(3) Electroplate with 95% tin/5% lead from a methane sulfonic acid based bath at 400 amps per square foot.

(4) Strip the ink maskant in an aqueous solution of sodium hydroxide and surfactants.

(5) Neutralize, rinse and dry the web.

After electroplating, the web was examined to determine the accuracy of the stripe location, integrity of the plated material, i.e., the absence of pinholes, definition of the stripe edge, thickness and/or composition of the plated metal layers, and adhesion of the plating, particularly at the boundaries of the unplated/plated area.

There were no adhesion failures found. Lack of adhesion failures at the boundary of the plated and unplated areas demonstrates that the ink masking was sharply defined. Generally when there is a blush at the ink/substrate interface, the thinner maskant will break down under the applied plating voltage. This results in uneven and often thin, non-adherent deposits at the edges of the unplated area.

It is appreciated that various modifications to the present inventive concepts described herein may be apparent to those of ordinary skill in the art without departing from the spirit and scope of the present invention as defined by the herein appended claims.

What is claimed is:

1. A method for continuously masking a web, comprising the steps of:

(a) providing a web of a conductive material having opposed major surfaces providing a first width and a length substantially longer than the first width of the web;

(b) providing a continuous masking apparatus comprising a plate roller having at least one proud area corresponding to an ink stripe to be coated on one of the major surfaces of the web; an ink source for transferring ink to the plate roller; an opposing roller disposed adjacent to the other major surface of the web opposite the plate roller for ensuring contact of the web with the plate roller; a radiation source for curing the ink on the web; and a motive means for moving the web through the continuous masking apparatus; and (c) actuating the motive means to move the web off of a spool to contact the plate roller and the opposing roller and to travel past the radiation source, wherein as the web moves past the plate roller, at least one stripe of ink is deposited on the web and the ink stripe is cured as the web moves past the radiation source, and including smearing the ink from the plate roller to the web along the length thereof.

2. The method of claim 1 including providing the web traveling either slower than or faster than a surface rate of rotation of the plate roller to provide the smeared ink on the web.

3. The method of claim 1 including providing a direction of travel of the plate roller opposite that of the web to provide the smeared ink on the web.

4. The method of claim 1 including providing the web traveling at a rate of speed of about 30 feet per minute to about 1,000 feet per minute.

5. The method of claim 1 including providing the continuous masking apparatus having at least one guide positioned either before or after where the web contacts the plate roller, and wherein the guide has spaced apart ceramic surfaces in contact with the opposed edges of the web.

6. The method of claim 5 including providing at least one of the ceramic surfaces as continuously adjustable perpendicular to a plane of a major surface of the web to compensate for variations in web width.

7. The method of claim 5 including providing at least one guide provided both before and after the plate roller.

8. The method of claim 6 including biasing the adjustable ceramic surface in contact with the edge of the web by a spring.

9. The method of claim 1 including providing at least one stripe of ink on each of its major surfaces.

10. The method of claim 1 wherein the web has a thickness between the opposed major surfaces of about 0.0005 inches to about 0.040 inches.

11. The method of claim 1 wherein the stripe of ink smeared on the web has a second width which is about ±0.010 inches of a third width of the proud area on the plate roller.

12. The method of claim 1 wherein a line taken along a boundary between the smeared ink stripe and an unmasked portion of the web has a wander of about ±0.0005 inches with respect to a longitudinal axis of the length of the web.

13. The method of claim 1 including providing a contact surface of the plate roller of a polymeric material.

* * * * *